US005242008A

United States Patent [19]

Rommel et al.

[11] Patent Number: 5,242,008

[45] Date of Patent: Sep. 7, 1993

[54] METHOD AND APPARATUS FOR PRODUCING CORES FOR FOUNDRY PURPOSES

[75] Inventors: Reiner Rommel, Brühl; Wolfgang Schimpf; Werner Landua, both of Mannheim, all of Fed. Rep. of Germany

[73] Assignee: Adolf Hottinger Maschinenbau GmbH, Mannheim, Fed. Rep. of Germany

[21] Appl. No.: 662,623

[22] Filed: Feb. 28, 1991

[30] Foreign Application Priority Data

Feb. 28, 1990 [DE] Fed. Rep. of Germany ..... 4006176

[51] Int. Cl.[5] ..... B22C 11/04; B22C 15/24

[52] U.S. Cl. ..... 164/16; 164/18; 164/28; 164/168; 164/181; 164/186

[58] Field of Search ..... 164/16, 18, 28, 168, 164/181, 186

[56] References Cited

U.S. PATENT DOCUMENTS

| | | | |
|---|---|---|---|
| 3,957,103 | 5/1976 | Fellows | 164/16 |
| 4,082,134 | 4/1978 | Zachary | 164/16 X |
| 4,083,396 | 4/1978 | Michelson | 164/16 X |
| 4,167,208 | 9/1979 | Buhrer | 164/18 |
| 4,184,533 | 1/1980 | Breitbarth | 164/16 X |
| 4,190,097 | 2/1980 | Allread et al. | 164/16 X |
| 4,210,194 | 7/1980 | Cina et al. | 164/16 |
| 4,809,763 | 3/1989 | Schilling | 164/28 |

FOREIGN PATENT DOCUMENTS

| | | | |
|---|---|---|---|
| 2456574 | 1/1981 | France | 164/181 |

*Primary Examiner*—J. Reed Batten, Jr.
*Attorney, Agent, or Firm*—Antonelli, Terry, Stout & Kraus

[57] ABSTRACT

For a production of foundry moulds, dies are stepwise, cyclically conveyed by a continuous conveyor and, synchronously with the dies, shot hoods are conveyed into a shot station which is common to both the dies and shot hoods, with the shot hoods being displaced with respect to the dies. For this purpose, a cyclically revolving die conveyor is provided for the dies, and a further conveyor is provided for the shot hoods, with the further conveyor revolving synchronously with the die conveyor. At least one shot station may be provided which is common to several dies and may be associated with the die conveyor in which dies and the associated shot hoods are conveyed by the die conveyor in a reciprocally displaced manner.

17 Claims, 5 Drawing Sheets

METHOD AND APPARATUS FOR PRODUCING CORES FOR FOUNDRY PURPOSES

FIELD OF THE INVENTION

The invention relates to a method and to an apparatus for producing moulds for foundry purposes, which comprise a plurality of interconnected mould parts and, in particular, with also core parts, the individual mould parts being individually moulded in a die comprising at least two partial boxes.

BACKGROUND OF THE INVENTION

A method and an apparatus of the aforementioned type are described in WO 87/07543 and corresponding U.S. Pat. No. 4,809,763, to which express reference is made, particularly with respect to the production of the mould/core parts. The known apparatus has conventional core moulding machines, whose number corresponds to the mould or core parts desired for a mould or a core. A displacing device is also provided enabling the mould parts produced in one of the partial boxes thereof to be displaced to a joining station, in which they are joined together to form the desired overall mould. Subsequently the partial boxes are returned to their moulding machine, so that the production of a corresponding mould part can take place therein.

It is disadvantageous that complicated and expensive moulding machines must be present in the same numbers as the mould parts necessary for producing the overall mould. The moulding machines are subject to considerable stoppage or delay times due to the time up to the mould part produced by them being ready for assembly in the joining station and during the joining or assembly of the mould part produced by the same. In addition, considerably manufacturing time is required for an overall mould due to the considerable displacement paths required and which necessarily rise overproportionally when there are several parts to be joined together to form a mould. In addition, the considerable number of linear displacements for the partial boxes and their mould parts are kinematically unfavorable.

SUMMARY OF THE INVENTION

The aim underlying the present invention essentially resides in providing a process and apparatus for producing molds which, while avoiding the aforementioned disadvantages of the prior art, permits improvement in the manufacture of mould parts by providing a smaller apparatus and lower constructional costs.

In the case of a process of the aforementioned type, this problem is inventively solved in that the dies are conveyed in stepwise, cyclic manner by a continuous conveyor, with the dies being synchronously conveyed with shot hoods or domes and with the domes or hoods being conveyed into a shot station common thereto in a position laterally displaced with respect to the dies.

An apparatus for producing moulds or cores for foundry purposes of the aforementioned type is characterized by at least one discontinuously, cyclically revolving die conveyor for the dies, a conveyor revolving synchronously therewith for the shot hoods adapted to the dies and at least one common shot station for several dies associated with a die conveyor, in which the dies and associated shot hoods are fed displaced with respect to one another by their conveyors.

As a result of the inventive solution only one device is required in the inventive apparatus for producing the mould parts, namely, a shot and gassing station, in order to produce moulds or cores from mould parts and, in particular moulding sand, to a desired, predetermined number of mould and core parts. The latter is solely determined by the number of dies or shot hoods provided on the corresponding conveyors. Generally an overall mould comprises two mould parts, a base part and a closing or terminating part, with a core formed from several core parts being located within or between the same. The number of core parts and the generally two mould parts then determines the total number of mould and core parts for the overall mould to be assembled.

In connection with the moulds normally to be produced and the number of mould parts necessary for the production thereof, it has been found that conveyors with ten dies are of an optimum nature. It is obviously possible to provide conveyors with less, e.g. five dies, or more, e.g. twelve dies.

As stated, only one shot device is required in the overall apparatus, but e.g. it is possible to provide on a single apparatus used for the production of moulds from a plurality of mould parts and which can correspondingly convey the same number of dies, can optionally have a further shot station, which can additionally be used if the apparatus is to be used for producing moulds which require far fewer individual mould parts, particularly the same number or less than half the total number of dies provided on the conveyor. Thus, using the inventive apparatus it is possible to simultaneously produce several dies.

An important advantage of the invention is that expensive, complicated shot and gassing stations need only be provided in accordance with the number of overall moulds to be produced, but not in accordance with the number of individual partial moulds. In addition, the shot and gassing station is substantially permanently in use and does not suffer from long stoppage times.

Another advantage is that the main movement of the dies can take place by a die carrier in the form of a carousel or merry-go-round performing a circular movement, which is kinematically more favourable than the reciprocating movement of a partial mould box for all the mould parts. Thus, according to a preferred embodiment, the conveyors for the dies and shot covers are circular conveyors, particularly in the form of carousels carrying the dies and shot covers by their circumference. According to a further development the revolving spindles of the conveyors are located in the area bounded by their circumference, but are relatively displaced at right angles to one another.

In order to improve the shooting in of the moulding sand mixture and also gassing, according to a further development, the shot or shooting station has a shot or shooting tank and gassing carriage or trolley with a shot or shooting tank and a gassing hood linearly movable over the die located in the station, and with the shot tank being provided with devices for receiving and transferring the shot hood over the die. Further improvements are achieved in that the shot station is positioned radially to the two pivots or that several mixing bunkers are provided, which can be centrally brought above the positioning point into which the shot hoods are brought by the shot hood carriers for shooting the core moulding material (sand) into the dies.

For further automation of the process sequence, a translating device is provided for receiving ejector plates and removing the same from the dies in a station upstream of the moulding station. According to further developments, the translating device has a swivel arm and the gassing hood has a device for receiving and ejecting the ejector plates.

According to a particularly preferred development, the shot station is connected a device (transfer station) for removing a basic mould box with the moulded mould part therein from the die carrier for the dies and for moving back into the vicinity of the following dies. This construction is further characterized by devices for holding moulded mould parts in top boxes of dies and for joining a thus held mould part to an optionally already joined set of mould parts held in a basic bottom box of another die. This development of the inventive apparatus and the corresponding inventive process sequence lead to the further advantage that, apart from the basic mould bottom box, no other mould box parts and, in particular, no mould box part of the other dies have to be removed from the cyclic or continuous conveyor for the dies which, as stated, is preferably constructed as a circulating carousel. Joining does not take place in a separate, remote joining station, as in the prior art, but in the secured dies. For this purpose their individual boxes are merely vertically spaced from one another. Use is made of the in any case necessary opening and closing movements of the dies and the necessary means, such as preferably hydraulic cylinders, for carrying out the joining process.

The invention also offers the advantageous possibility that the thus constructed transfer station is provided at its end remote from the first conveyor with a further conveyor, preferably in the form of a carousel and having its own shot and gassing station, so that in the individual shot stations in alternating manner parts which are to be joined together are moulded and the individual mould parts are alternately brought by one or other conveyor to the transfer station, where they are joined to the already assembled individual mould parts by introducing the same into the particular conveyor area.

In such a construction, it is preferable that at least one of the continuous conveyors has a further transfer station, so that if moulds with a smaller number of mould parts are produced, the two apparatuses can operate independently of one another. This construction offers the possibility of automatically producing mould parts with a large number of individual mould parts by combined operation of the two conveyors, whereas, in other cases, two moulds, optionally also of a different nature and with a different number of mould parts, can be independently produced in parallel on the machines.

If moulds with a large number of mould parts and moulds with a smaller number of mould parts are to be produced at the same production point, then the batch quantity distribution will determine whether a circular conveyor with a large number of dies and one or two moulding stations or two circular conveyors with a smaller number of dies and a common transfer station are used.

The invention also offers the possibility that in the case where the moulds are to be produced from a number of mould parts which is larger than the number of dies in the apparatus, optionally, preferably, individual mould parts can be separately produced on separate moulding machines and can be separately used in the transfer station.

BRIEF DESCRIPTION OF THE DRAWINGS

The invention is described in greater detail hereinafter relative to a nonlimitative embodiment and the attached drawings, wherein.

DETAILED DESCRIPTION

Figure 4:
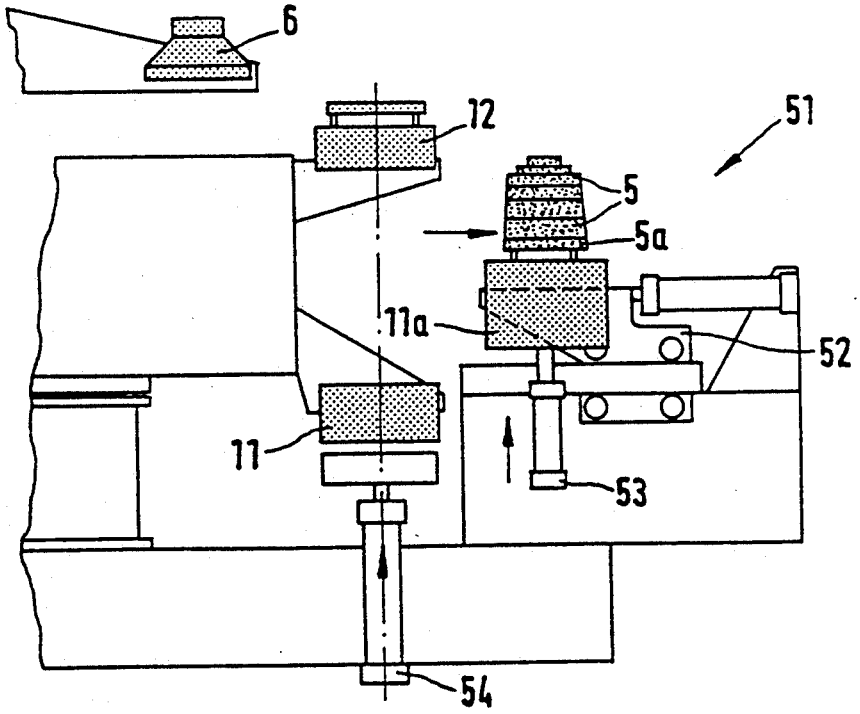
FIG. 4 is a view taken in the direction of the arrow IV in FIG. 1 of a removal station of the inventive apparatus.

The inventive apparatus for producing moulds for foundry purposes and, in particular, for producing sand cores or the like, is provided on a column 1*a* (FIG. 2) with a die carrier 1 in the form of a circular conveyor for the dies 2, which are located on the circumference of the die carrier 1. The die carrier 1 is rotatable about a pivot 3. The mould parts 5, 5*a* to be assembled (FIGS. 4 and 5), particularly core parts, are produced in the manner described hereinafter in the closed dies 2.

Above the die carrier 1 is provided a shot or shooting hood carrier 4 for shot or shooting hood 6, which is also constructed as a circular conveyor and rotates about a pivot 7.

The die carrier 1 and shot hood carrier 4 are preferably constructed as turnstiles with support arms fixed for the dies 2 or shot hoods 6 on a turntable and each driven by a precision and indexing table.

Figure 1:
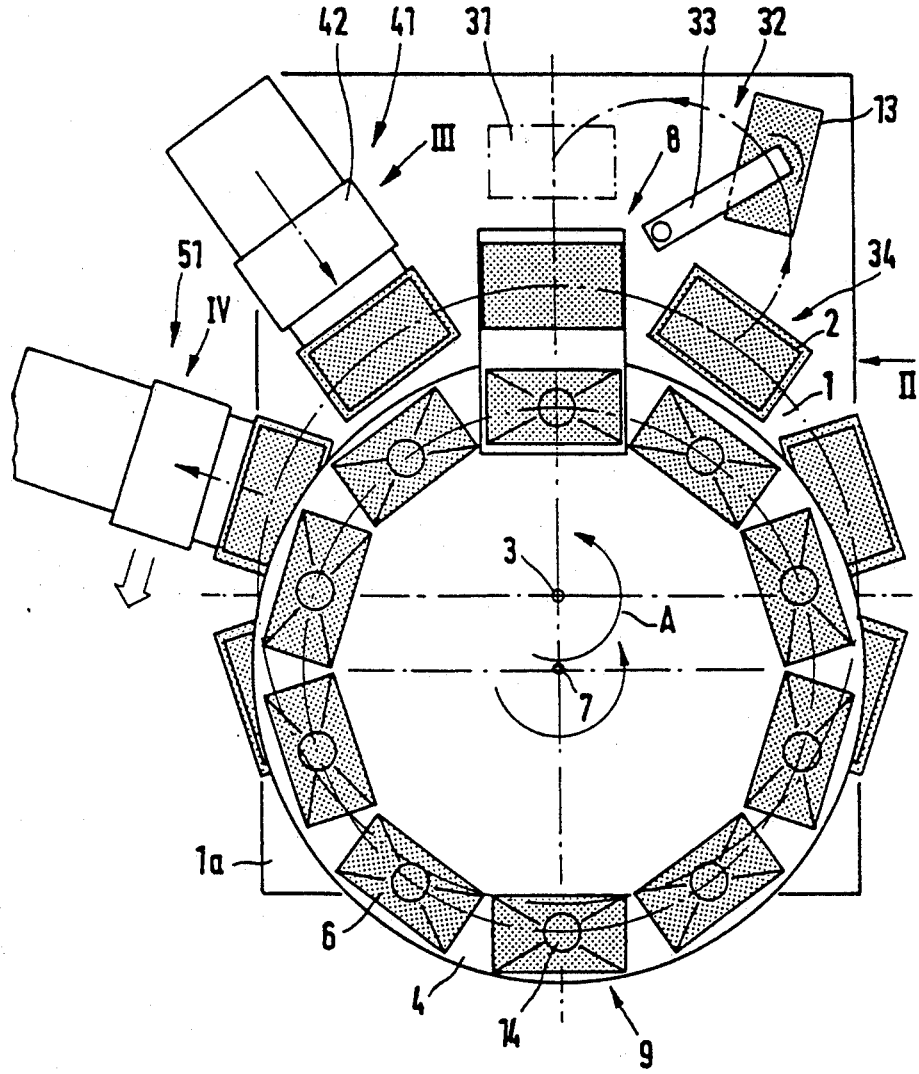
FIG. 1 is a schematic top view of a preferred embodiment of the inventive apparatus.
Figure 2:
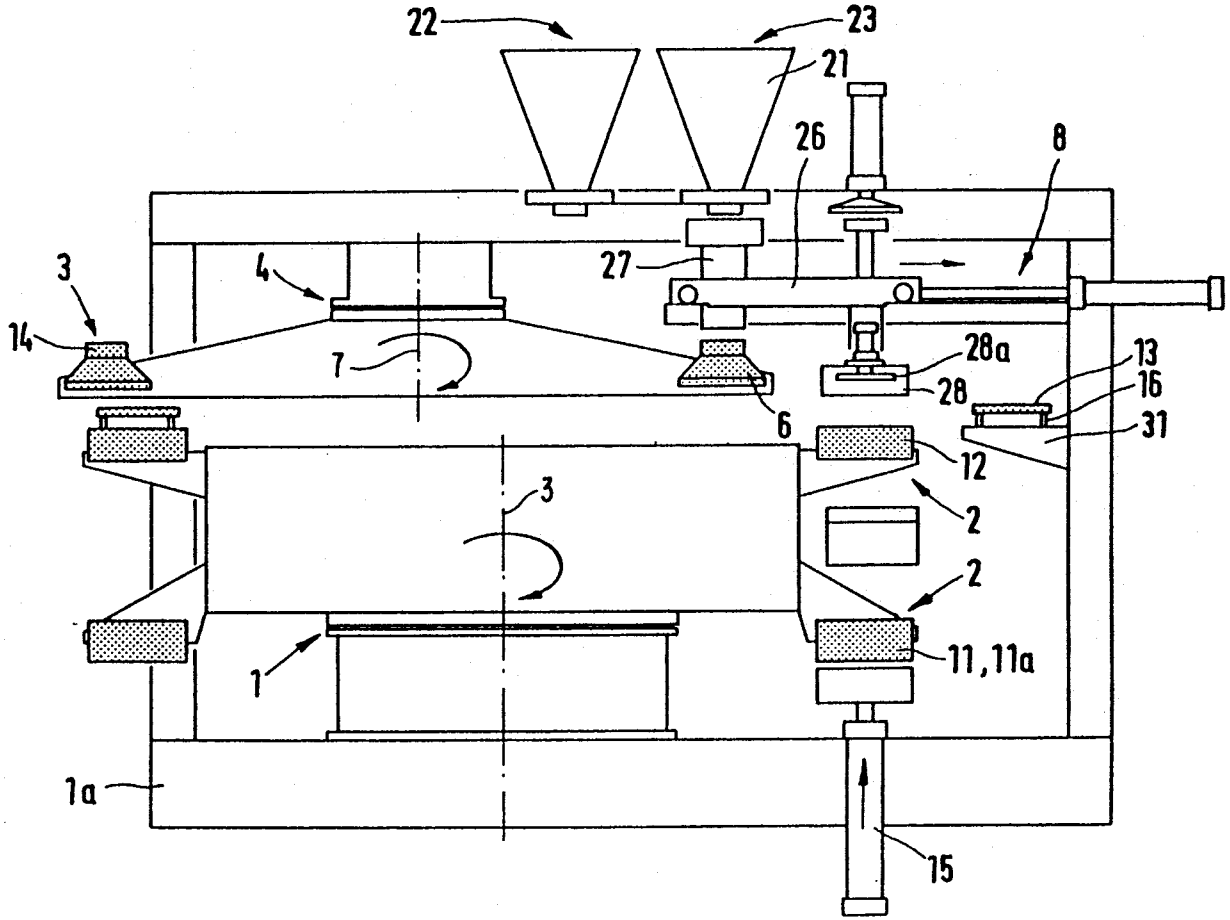
FIG. 2 is a side view taken in the direction of the arrow II in FIG. 1.
Figure 3:
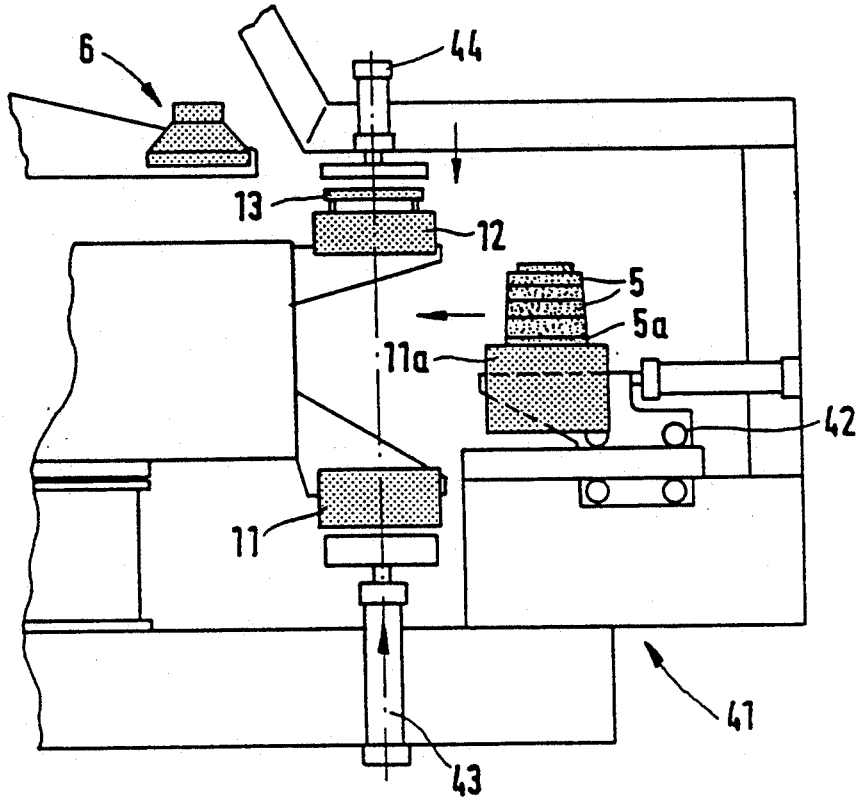
FIG. 3 is a view taken in the direction of the arrow III in FIG. 1 of a transfer station of the inventive apparatus.

In the vicinity of a device 8 for producing the mould parts and known as the shot or shooting station 8 are provided the dies 2 carried by the die carriers 1 and the associated shot hood 6 corresponding to each die 2. They are horizontally reciprocally displaced, i.e. at right angles to their pivots 3, 7, as shown in FIGS. 1 and 2. An optimum, compact apparatus is then achieved in that the two pivots 3, 7 are displaced relative to one another in an extension of the shot station 8 and the shot hood carrier 4 has a circumference allowing the reception of the desired number of shot hoods 6. If coinciding axes or pivots were chosen on the basis of the latter, then for the desired displacement in the shot station 8, larger dimensions for the overall apparatus would be obtained.

The shot hoods 6 pass over the particular die 2 in the area diagonally facing the shot station 8 over the pivots 3, 7 (at 9).

In a known manner the dies 2 comprise a bottom box 11, a top box 12 and ejector plates 13 adapted thereto. As stated, above with each die is associated an adapted shot hood 6, which has shot channel (not shown) emanating from a central shooting opening 14 and which leads to the shot bores constructed in the upper die 12 for ejector bars 16 of the ejector plates 13 and, consequently, allow moulding sand to be shot through the same.

The shot station 8 has one or more mixing bunkers 21 (two in the illustrated embodiment), which can be moved from a readiness position 22 into a use position 23, which is centrally located above the position into which is moved a shot hood 6 by the shot hood carrier 4 in the parts moulding station. Between the mixing bunker 21 there and the shot hood 6 carried by the shot hood carrier 4 is provided a shot tank and gassing carriage or trolley 26, (FIG. 2) which is horizontally movable. The carriage or trolley 26 carries a shot tank 27 and, at a distance corresponding to the horizontal spacing of the shot hoods and dies in the parts moulding station, a gassing hood 28, which is provided with an ejector 28*a*, by which, following gassing, it can eject a moulded basic mould part out of the top box by an ejector plate 13 with ejector bars 16, so that it remains in the bottom box. The ejector bars 16 on the ejector plate 13 push through the shot bores in the top box 12.

The shot tank and gassing carriage or trolley 26 moves radially to the two pivots 3, 7, i.e. in alignment therewith. A depositing plate or location 31 for the upper ejector plates 13 is provided radially outside the dies 2 at a distance corresponding to the aforementioned horizontal spacing between the shot hoods and the dies or shot tank 27 and gassing hood 28 on the carriage 26.

There is also a translating device 32 for the ejector plates 13, which is positioned upstream of the shot station 8 in such a way that the device 32 can take up with a swivel arm 33 in a die position upstream of the shot station 8 the ejector plate 13 belonging to the die 2 located there and can transfer it to and deposit it in the depositing location 31. The ejector plate 13 is pivoted counter to the transfer movement of the arm 33 taking place over substantially 180° in such a manner that its outside always remains radially outwardly directed, i.e. in the take-over position 34, but also on the depositing plate 31, so that the plate 13 is taken from the latter by the gassing hood 28 and, following the radially inwardly directed, linear movement thereof, can again be correctly placed on the top box 12 of the die 2.

A transfer station 41 is located in rotation direction A behind the shot station 8. The transfer station 41 has a transfer carriage or trolley 42 for receiving one of two basic mould bottom boxes 11*a* (transfer boxes) of a basic part die used in the apparatus.

Lifting devices 43 are provided at the transfer station for the die bottom boxes 11 and for the die top boxes ejectors 44, which are subject to hydraulic action. The other horizontal and vertical linear movements take place hydraulically through the hydraulic cylinders indicated in the drawings.

A removal station 51 is associated with a further stationary position of the dies 2. It also has a radially movable carriage or trolley, namely, a removal carriage 52 for the basic shape bottom box 11*a* and, in the retracted position of the carriage 52, an ejector 53 for ejecting the mould or cores located therein.

A lifting device 54 is provided in the path of the dies 2 required by the die carrier 1 and below the bottom box.

After ejecting from the basic mould bottom box 11*a*, the moulds or cores assembled from the individual mould parts 5, 5*a* can be removed from the removal station either manually and, optionally with aids, or a known removal mechanism may be provided for the same.

In the inventive apparatus the two carriers 1, 4 revolve synchronously. If the die 2 with the basic mould bottom box 11*a* reaches the station 34, the arm 33 grasps the associated, individual, upper ejector plate 13 conveyed into the station 34 with the die 2 and transfers it to the depositing point for the ejector plate 13. Simultaneously, the remaining die moves out of the basic mould bottom box 11*a* and top box 12 and also the associated shot hood 6 into the shot station 8.

In the meantime the shot tank 27 has been filled with sand from the mixing bunker 21 moved over it. The shot tank and gassing carriage or trolley 26 takes up the shot hood and moves it with the shot tank 27 above the die 2. The latter is initially closed by the lifting device 17, in that the bottom box 11 or 11*a* is raised against the top box 12 and both are raised together against the underside of the shot hood 6 and together with the latter against the shot tank 27. The sand in the latter is then distributed in conventional manner by the shot hood 6, its channels and the shot bores in the top box 12 and is shot into the interior of the die 2.

In the meantime the gassing hood takes up the ejector plate 13 from the depositing plate 31. In a next step the gassing hood 28 with the ejector plate 13 is moved over the die 2 and is engaged thereon in gas-tight manner with its circumferential edge. This is followed by gassing with a catalytically acting gas, so that a binder added to the sand is activated and, consequently, the sand-binder mixture solidifies in the die.

During the production of the basic mould part 5*a*, in a further working step the die 2 is lowered, as is the bottom box 11*a* relative to the top box 12, by the cylinder 18*a*. Therefore, the ejector plate 13, which in the closed state of the die is supported by bars or feet on the bottom box 11*a*, is released and, simultaneously with the downward movement of the basic bottom box 11*a*, with its ejector bars 16 releases the moulded basic mould part 5*a* or basic core from the top box and presses it into the basic bottom box 11*a*. If the ejector bars 16 are spring loaded in an upward direction for safety reasons, this can optionally take place by additional force action, e.g. by additional pressing down of an ejector plunger 28*a* located in the gassing hood 28. The fixed basic mould part 5*a* is then in the basic bottom box 11*a*. The latter is then moved into the following transfer station 41. If the bottom box of the basic bottom box 11*a* is that which in the mould assembled from several mould parts 5, 5*a* is located in the lowest position, then it is taken up by the transfer carriage 42 and is moved radially outwardly in the transfer station 41 together with the basic mould part 5*a* located therein.

In the next step the associated top box 12 passes into the removal station 51 and takes up from there a second, identically constructed basic mould bottom box 11*a*. Thus, in the represented apparatus working takes place with two basic mould bottom boxes 11*a*, whereas there is only one each of the other bottom boxes 11, top boxes 12 and shot hoods 6.

If the basic mould part 5*a* produced in the above-described manner and left in the basic mould bottom box 11*a* is transferred from the shot station 8 into the transfer station 41, simultaneously another die 2 with associated shot hood is moved into the shot station 8. The process sequence for the production and solidification of said second mould part are the same as described hereinbefore and only the final step differs.

During the separation of the boxes 11, 12 a mould part 5 is not pushed from the top box 12 into the bottom box 11, but instead an ejector plate located below the box 11 is removed from the same, so that the mould part 5 sticks in the top box 12. This adhesion and in particular that in the top box can be set in desired manner.

The moulded mould part 5 is then brought into the transfer station 41 with the die 2 open and adhering in the top box 12. The transfer carriage 42 then moves the basic mould part 5a previously transferred to it in the basic mould bottom box 11a together therewith into the open die 2 and in particular under the mould part 5 subsequently held in its top box 12. The basic mould bottom box 11a and top box 12 with the corresponding mould parts 5a, 5 are now brought together, e.g. in that the bottom box 11a is raised by the lifting device 43 of the transfer station 41 indirectly by means of its bottom box 11 against the top box 12. During the subsequent lowering the ejector 44 presses the ejector plate 13 with its ejector bars 16 in the downward direction, so that the mould part 5 initially in the top box 12 on lowering the basic mould bottom box 11a and the basic mould part 5a located therein is forced out of the top box 12 and is lowered with the bottom box 11a and the mould part 5 located therein. Thus, the second mould part is joined to the basic mould part 5a.

The die for the second mould part passes through the removal station 51 without any displacement process taking place there. All the other mould parts from which ultimately the mould is to be assembled are produced in the same way and connected to the mould parts 5, 5a previously assembled in the basic mould bottom box 11a.

Figure 5:
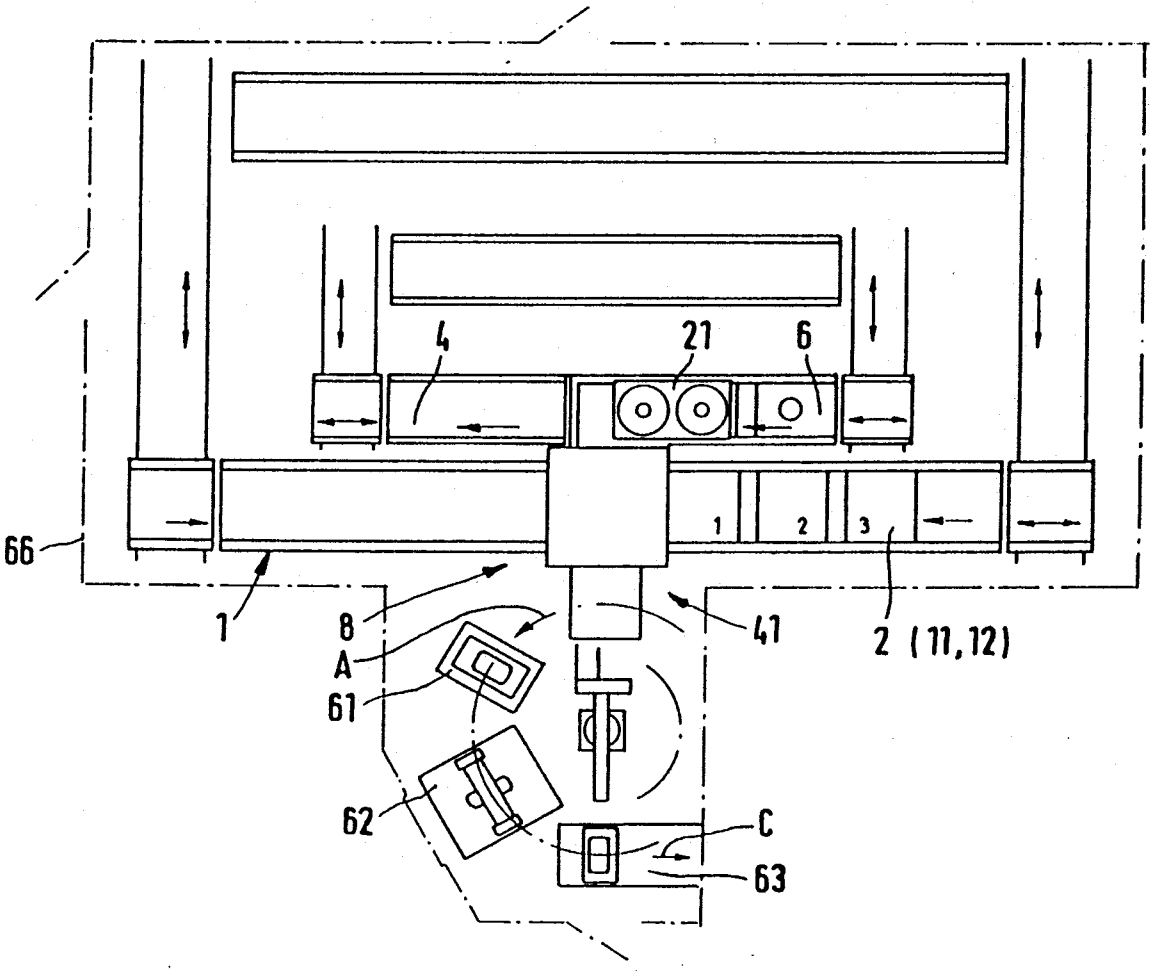
FIG. 5 is a schematic view of another construction of an inventive apparatus for performing the inventive process.

When the mould to be created is complete, i.e. the final mould part has been assembled, the transfer carriage 42 does not move the mould-carrying basic mould bottom box 11a out of the die carrier 1 again and instead it brings the bottom box 11a together with the complete mould assembled therein to the removal station 51 (as shown in FIG. 5).

The removal trolley or carriage 52 of the station takes over the basic mould bottom box 11a together with the mould located therein from the die carrier 1 and moves it radially outwards. The assembled mould is then ejected from the basic mould bottom box 11a by the ejector 53 and the mould can be removed out of the inventive apparatus in the aforementioned manner.

The transfer of the basic mould bottom box 11a with the finished mould to the removal carriage 52 takes place by the lifting device 54 as described in connection with the transfer station hereinbefore.

Simultaneously the second basic mould bottom box 11a has again passed into the transfer station 41 and, in the latter, is removed from the die carrier 1. Thus, during the next cycle a die carrier element with a missing basic mould bottom box 11a passes into the removal station 51, so that the first basic mould bottom box 11a located therein is again brought into its place in the die carrier 1 by the carriage 53. Thus, the first basic mould bottom box 11a is ready to mould a second basic mould part.

A highly preferred development of the invention has been described hereinbefore with respect to the accompanying drawings; however, numerous variations are possible within the scope of the invention. In the illustrated apparatus is provided a carousel with ten mould parts, which are to be moulded to form a mould using a shot station 8. In this development the inventive apparatus has been optimized from the construction and use standpoints, i.e. an optimum size has been chosen, in which for most moulds to be produced all the mould parts 5, 5a can be produced with the present apparatus. However, the inventive apparatus also offers the possibility of producing moulds with more than ten mould parts, in that in the transfer station 41 mould parts produced on conventional moulding machines are supplied and used manually or as described in WO 87/07543. Alternatively, the represented transfer station 41 is simultaneously a transfer station for another inventive apparatus with a die carrier 1 having ten or less dies, so that in the described manner and using the second carousel and its associated shot station 8, the corresponding parts are moulded in the described manner and in the common transfer station 41 the overall mould can be assembled from the individual mould parts.

It is optionally possible to use die carrier carousels with less dies, e.g. with in each case five dies. It is desirable, but not necessary for the position of the transfer station 41 and directly following onto the same the removal station 51 to be close to the shot station 8. Thus, for example, a first transfer station 41 can be provided in an inventive apparatus, which constitutes a common station for two die carrier carousels. A further transfer station can be provided in the movement direction behind the same and no further carousel is associated therewith. Obviously it is also followed by a removal station. In such a construction two die carrier carousels can cooperate for producing moulds with several individual parts or they can produce independently of one another moulds with less individual mould parts. One of the transfer stations is used by a carousel, which need not have any other, while the other transfer station 41 is only used by the carousel with which it is associated. While the arrangement of the die carrier and the shot hood carrier described hereinbefore is the optimum arrangement, both can be arranged concentrically to one another or displaced in such a way that there is no intersection of the path of the circumferential edge thereof and instead the shot hood 6 is supplied from the outside in the vicinity of the shot station 8. However, as is clear, the illustrated construction constitutes an optimum. In addition, the continuous conveyors carrying the dies 2 and the shot hood 6 need not be constructed as circular conveyors or carousels and can instead comprise a conveying chain or the like e.g. travelling a round a rectangle, square, oval, ellipse, etc. and which carries the corresponding mounting supports for the dies 2 and the shot hoods 6.

Figure 6:
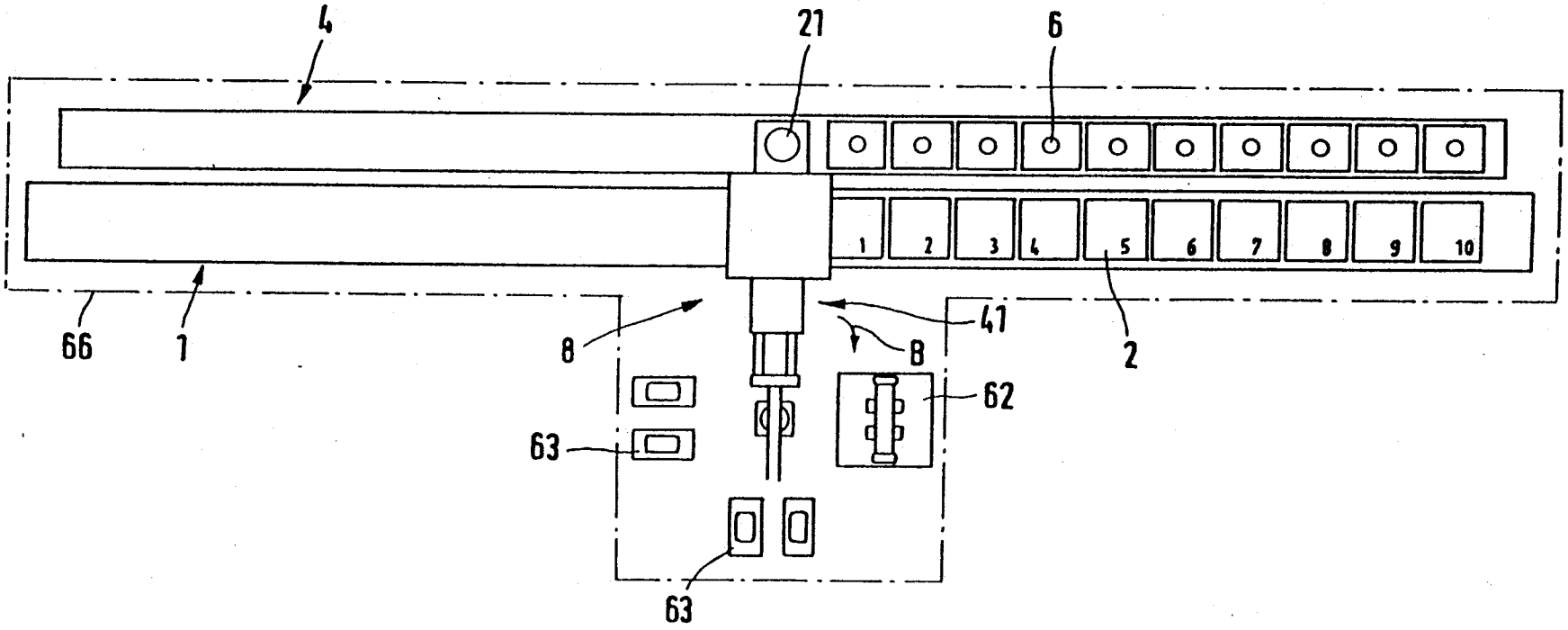
FIG. 6 is a schematic view of yet another construction of an inventive apparatus for performing the inventive process.

Further preferred developments of the inventive apparatus for performing the inventive process are diagrammatically shown in FIGS. 5 and 6. If individual parts basically coincide, they are given the same reference numerals as in FIGS. 1 to 4. If in FIGS. 5 and 6, certain elements are not shown in detail, they can be constructed in the manner shown in FIGS. 1 to 4 and are described with reference thereto.

In the constructions of FIGS. 5 and 6 the die carrier 1 is constructed as a die roller conveyor. In the construction of FIG. 5 the die conveyor 1 is constructed as a rectangularly circulating continuous conveyor in which the dies revolve. This also applies with respect to the shot cover carrier 4 also constructed as a roller conveyor for the shot hoods 6. The paths 1 and 4 are here again height-displaced. Whereas, in the embodiment of FIG. 5 the shot hood carrier 4 is located entirely within the die carrier 1, it could also be guided in the rear part (top in FIG. 5) over the part of the die carrier 1 located there.

The shot station 8 is also diagrammatically shown. Unlike in the case of the construction of FIGS. 1 and 2, in which the dies 2, having mould parts shot into it are conveyed by the die conveyor 1 to a transfer station 41 separate from the shot station 8, the transfer station 41 in FIGS. 5 and 6 is directly located at the shot station 8.

Separately from the die conveyor 1, the transfer station 41 is follwed by a depositing location 61, from where the produced mould packs can be directly conveyed into a casting means 62 and from there, via a depositing location 63 for the casting, to a further processing station for the cast parts.

The construction of the apparatus fo FIG. 6 is similar; however, the die and shot hood carriers 1, 4 have a linear construction, which leads to a reciprocating conveying of the dies 2 and the shot hoods 6. In FIG. 5 the assembled moulds are conveyed to the left in the direction of arrow A and in FIG. 6 to the right in the direction of arrow B.

The working sequence is fundamentally the same as described in connection with FIGS. 1 to 4. The first die with the basic mould bottom box firstly passes into the shot station 8, where the associated shot hood 6 and, via the latter, are moved the mixing bunker 21, as well as a shot tank and gassing carriage (not shown, reference being made to FIGS. 1 and 2). The basic mould is then produced in the manner described in connection with FIGS. 1 and 2. In the shot station 8 separation then takes place of the top and bottom boxes of the basic die. In the manner described hereinbefore the moulded basic mould part remains in the basic mould bottom box, which is moved by a transfer carriage of the transfer station 41 out of the shot station 8 at right angles to the die carrier path 1, while the associated top box is conveyed on along the path 1. Simultaneously, the next die 2 is conveyed into the shot station 8. The core part to be produce in this die is then produced in the manner described hereinbefore. The die is then opened, in that the top and bottom boxes are separted, the core part produced being ejected from the bottom box and remains in the top box. The transfer carriage of the transfer station 41 then introduces the basic mould bottom box with the basic mould part therein into the open, following die. The core part produced therein is ejected from its top box and with the basic mould bottom box and the basic mould part located therein are moved by the transfer station 41 out of the shot station 8 again. The top and bottom boxes of the second die are then conveyed along the die carrier path 1 out of the shot station 8. The production of further core and mould parts and the assembly of the individual parts to form the overall mould then takes place in the manner described hereinbefore, cf. FIGS. 1 to 3. After producing the complete mould it can be conveyed in the direction of arrow A to the depositing point for the core pack 61 and from there to the casting point in casting means 62, from which the casting, optionally after intermediate deposition in 63, is conveyed out of the apparatus in the direction of arrow C. The top box of the first die then again reaches the shot station 8, where the basic mould bottom box, freed from the core pack, is introduced into the shot station 8, so that the following mould parts for a further core pack and the latter can be produced. It is optionally possible to work here in the manner described hereinbefore with two basic mould bottom boxes for one associated top box.

The sequence for the construction according to FIG. 6 is fundamentally the same, except that after producing all the mould and core parts, as well as the core pack assembled therefrom, the dies 2 and the shot hood 6 are moved back in the opposite direction to the original conveying direction during processing. If the top box of the first die is moved through the shot station 8, simultaneously the transfer station 41 brings the associated basic mould bottom box into the shot station, where it is assembled with the top box. Then in the same way it is possible to produce the individual mould and core parts for the next mould or core pack and the latter.

Other variants are also possible within the scope of the inventive concept.

We claim:

1. Apparatus for the production of foundry moulds including a plurality of interconnected mould parts, each of the mould parts being individually moulded in a die comprising at least two partial boxes, the apparatus comprising:

a plurality of shot hoods adapted to the respective die, at least one die conveyor for conveying the dies in a timed manner, a further conveyor operating synchronously with the at least one die conveyor for conveying the shot hoods, and at least one shot station associated with the die conveyor to which the dies and associated shot hoods are initially fed in a stepwise manner by the at least one die conveyor and the further conveyor and in which the shot hoods and dies are locked above one another in the shot station for enabling a shooting of the mould parts.

2. Apparatus according to claim 1, wherein the at least one shot station includes a shot tank and a gassing carriage with a shot tank and a gassing hood movable in a linear direction over the die and located in the at least one shot station, and wherein the shot tank is provided with means for receiving and transferring the respective shot hood over the associated die.

3. Apparatus according to one of claims 1 or 2, further comprising a plurality of ejector plates, a translation device for gripping the ejector plates and removing said ejector plates from the dies in a holding station of the at least one die conveyor at a position upstream of the at least one shot station.

4. Apparatus according to claim 3, wherein the translation device includes a swivel arm.

5. Apparatus according to claim 3, wherein the gassing hood includes means for receiving and ejecting the ejector plates.

6. Apparatus according to one of claims 1 or 2, wherein the die conveyor for the dies and the further conveyor are circular conveyors fashioned as carousels adapted to respectively carry the dies and the shot hoods along a circumference of said carousels.

7. Apparatus according to claim 6, wherein pivots of the respective circular conveyors are displaced relative to one another at right angles to longitudinal axes of the respective pivots.

8. Apparatus according to claim 7, wherein the at least one shot station is positioned radially with respect to the pivots of the die conveyor and further conveyor.

9. Apparatus according to one of claims 1 or 2, further comprising a plurality of mixing bunkers adapted to be brought centrally above one another into a positioning point at which said shot hoods are brought by said further conveyor for enabling a shooting of core moulding material into the respective dies.

10. Apparatus according to claim 2, wherein a transfer device is arranged downstream of the at least one shot station for removing a mould bottom box with a lowest moulded mould part therein from said die conveyor and for returning to a vicinity of subsequent open dies on the die conveyor.

11. Apparatus according to one of claims 1 or 2, wherein the at least two partial boxes of the respective dies include a top box and a bottom box, and wherein means are provided for holding moulded mould parts in the top box of the respective dies and for joining a thus held moulded mould part to an optionally already joined mould parts located in the bottom box of another die.

12. Apparatus according to one of claims 1 or 2, further comprising a removal station for removing a mould assembled from the mould parts and located in a lowest mould bottom box from the die conveyor and for returning an empty lowest mould bottom box to the die conveyor.

13. Method for producing foundry moulds comprising a plurality of interconnected mould parts, the individual mould parts being individually moulded in dies comprising at least two partial boxes, the method comprising the steps of:

conveying respective dies in a stepwise manner by a conveyor;

conveying shot hoods associated with the respective dies in synchronism with the stepwise conveying of the respective dies, and wherein the shot hoods are initially conveyed to a shot station common to both the shot hoods and to the dies into a position laterally displaced with respect to the dies and then the shot hoods and dies are brought in a superimposed manner into a shooting position.

14. Method according to claim 13, wherein the respective shot hoods in the shot station are linearly brought over the dies, and wherein the shot hood and the dies are moved toward one another for enabling shooting of moulding sand mixture.

15. Method according to claim 13, further comprising the steps of continuously conveying ejector plates with the respective dies, raising the respective ejector plates from the respective dies at a position upstream of the shot station, moving the respective ejector plates out of a movement path, bringing a respective ejector plate into the shot station so as to be received by a gassing hood and, after shooting a moulding sand mixture into the dies, linearly moving the respective ejector plates over the associated dies and joining the same together with the respective dies.

16. Method according to one of claims 13 or 14, wherein, after each mould part is produced, a lowest mould bottom box with assembled mould parts therein is linearly moved out of the movement path of the dies, and, for receiving and joining at least one further mould part, is alternately introduced into a movement path of the dies until a desired mould is completely assembled from the respective mould parts.

17. Method according to claim 16, wherein the mould parts are assembled in such a manner that a lowest mould part and optionally further previously assembled mould parts are raised against a further mould part to be mounted and the further mould part is then pressed out of a top box of the at least two partial boxes against the lowest mould part and the at least one further mould part.

* * * * *